US007314265B2

(12) United States Patent
Sato

(10) Patent No.: US 7,314,265 B2
(45) Date of Patent: Jan. 1, 2008

(54) RECORDING APPARATUS

(75) Inventor: Noriko Sato, Mitaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 10/764,547

(22) Filed: Jan. 27, 2004

(65) Prior Publication Data

US 2004/0252159 A1 Dec. 16, 2004

(30) Foreign Application Priority Data

Jan. 31, 2003 (JP) ..... 2003-024041

(51) Int. Cl.
*B41J 23/00* (2006.01)
*B41J 11/44* (2006.01)

(52) U.S. Cl. ..... 347/37; 400/76

(58) Field of Classification Search ..... 347/37, 347/9, 14, 19, 20; 400/352, 354, 76, 283–358
See application file for complete search history.

(56) References Cited

U.S. PATENT DOCUMENTS 5,075,609 A * 12/1991 Ito et al. ..... 318/696
5,354,136 A * 10/1994 Takizawa et al. ..... 400/185
5,673,074 A * 9/1997 Miyauchi et al. ..... 347/104

FOREIGN PATENT DOCUMENTS

| | | |
|---|---|---|
| EP | 1 029 696 | 8/2000 |
| GB | 2 354 201 | 3/2001 |
| JP | 9-226201 | 9/1997 |
| JP | 2000-141802 | 5/2000 |

* cited by examiner

*Primary Examiner*—Stephen Meier
*Assistant Examiner*—Leonard Liang
(74) *Attorney, Agent, or Firm*—Fitzpatrick, Cella, Harper & Scinto

(57) ABSTRACT

A recording apparatus includes a carriage for carrying a recording head and being scanningly movable in the apparatus; a guide shaft for guiding the carriage in a predetermined scanning direction; a drive transmitting portion for transmitting a driving force for scanning movement of the carriage; an elongated member in which information relating to a position of the carriage in the predetermined direction is recorded, the elongated member being elongate in the predetermined direction, and the elongated member being disposed across the carriage from the guide shaft; and a detecting member, provided in the carriage, for detecting information relating to the position in the predetermined direction recorded in the elongated member.

4 Claims, 5 Drawing Sheets

RECORDING APPARATUS

FIELD OF THE INVENTION AND RELATED ART

The present invention relates to a recording apparatus comprising a recording head-holding member, which is reciprocally moved while holding a recording head. More specifically, it relates to the positioning of an encoder for detecting the positioning of a recording head holding member, in terms of the direction in which the recording head holding member is moved.

There have been proposed various recording apparatuses for recording an image on recording medium such as paper, OHP sheet, etc. They are different in the type of a recording method they employ, as well as the type of a recording head they employ. As for the recording method employed by a recording head, there are the wire dot recording method, thermal recording method, thermal transfer recording method, ink jet recording method, etc.

Among the above mentioned recording methods, the ink jet recording method, which directly ejects ink toward recording medium, is more widely in use than the others, because it is quieter in recording operation and lower in operational cost.

An ink jet recording apparatus has been remarkably improved in performance. For example, it has been enabled to record letters and pictures in color, has been increased in recording speed, and has been improved in image quality. Further, it has been reduced in size, being therefore placeable on a desk in a personal office. As a result, an ink jet recording apparatus has come to be used even in an average household. In other words, an ink jet recording apparatus has become one of the familiar things in out lives. Recently, however, an ink jet recording apparatus been desired to be further reduced in size and weight, without being reduced in performance. In particular, it is desired to be reduced in thickness so that it can be placed in a book shelf, a desk, etc., when it is not in use.

One of the mainstream recording apparatuses, that is, the most widely used recording apparatuses, is a so-called serial type recording apparatus. A serial type recording apparatus comprises a carriage, that is, a member which holds a recording head. It records by reciprocally moving the carriage in the direction intersectional (preferably, perpendicular) to the direction in which recording medium is conveyed. One of the reasons for its popularity is that the recording head employed by a serial type recording apparatus is substantially smaller than the range across which it is capable of recording, making it easier to reduce a recording apparatus in size and cost.

A serial type recording apparatus forms an image in sections by driving its recording head in synchronism with the reciprocal movement of its carriage. Thus, in order to form a highly precise image with the use of a serial type recording apparatus, it is mandatory for the carriage to be smooth in movement, that is, stable in speed and attitude while it is reciprocally moved. In recent years, therefore, the combination of a DC motor and a feedback system has come to be employed as a means for driving the carriage; the speed, or the like, of the DC motor detected by an encoder is fed back to the means for controlling the carriage movement.

As the means for transmitting driving force from the DC motor to the carriage, a timing belt is widely used. A timing belt is suspended by a rotatably supported idler pulley and a driver pulley solidly fixed to the rotational axis of the DC motor, roughly in parallel to the direction in which the carriage is reciprocally moved. As the DC motor is driven forward or in reverse, the driver pulley is rotated in forward or in reverse, moving the timing belt forward or in reverse. As a result, the carriage is reciprocally moved. The encoder as a position detecting means is attached to the carriage, and detects the position, speed, etc., of the carriage, by reading, through its optical or magnetic detecting means, the information on an encoder scale, which is a long and narrow member extended roughly in parallel to the direction in which the carriage is reciprocally moved.

A recording apparatus is also provided with a guiding shaft as a guiding member for guiding the carriage, and a guiding rail positioned roughly in parallel to the guide shaft. The guiding shaft and guiding rail are to hold the carriage stable in attitude so that a proper amount of gap is maintained between the recording head and recording medium, across the entirety of the range in which the carriage is reciprocally moved, while the carriage is reciprocally moved. Further, one of them is placed on the opposite side of the center of gravity of the combination of the carriage and a recording head thereon, from the other. Moreover, they are disposed, either with one of them positioned roughly above the other (so that they overlap in the direction roughly perpendicular to bottom surface of recording apparatus main assembly), or both of them positioned roughly at the same level. In either case, the distance between them is desired to be as wide as possible in order to keep the carriage stable in attitude.

The guiding shaft supports the carriage at multiple points (generally, two points), with the interposition of bearings, one for one, whereas the guiding rail supports the carriage at one point, with the interposition of a bearing. The carriage is moved in the space between the guiding shaft and guiding rail, while sliding on the guiding shaft and guiding rail. Thus, the timing belt for moving the carriage is positioned in the adjacencies of the guiding shaft, which is greater in the friction against the carriage.

The force applied to the carriage through the timing belt in order to move the carriage also acts in the direction to rotate the carriage about the center of gravity of the combination of the carriage and recording head, and so does the friction between the guiding rail and carriage. In other words, the force applied through the timing belt to the carriage and the friction between the guiding rail and carriage act in the same direction, thereby inducing rotational moment in the carriage. Thus, in the case of the structural arrangement in which the guiding shaft and guiding rail are disposed parallel to each other, in the manner to overlap roughly in the vertical direction, with the guiding shaft being positioned on the opposite side of the center of gravity of the combination of the carriage and recording head, from the guiding rail, this rotational moment acts in the direction to rotate the carriage in parallel to the plane perpendicular to the recording paper as well as the direction in which the carriage is reciprocally moved, whereas in the case of the structural arrangement in which the guiding shaft and guiding rail are disposed in parallel to each other, at the same level, with the guiding shaft being positioned on the opposite side of the center of gravity of the combination of the carriage and recording head, from the guiding rail, this rotational moment acts in the direction to rotate the carriage in parallel to the plane parallel to the recording paper. In other words, the attitude of the carriage is prone to be changed by the force applied to the carriage through the timing belt to reciprocally move the carriage, and the change in the carriage attitude reduces the level of accuracy at which an image is recorded. The amount by which the recording accuracy is reduced is much greater in the case of the latter arrangement. Thus, in the case of a recording apparatus for forming a highly precise image, generally, the guiding shaft and guiding rail are disposed parallel to each other, roughly at the same level, and the encoder and encoder scale are positioned in the adjacencies of the guiding shaft, or the location at which driving force is transmitted to the timing belt.

However, positioning the guiding shaft and guiding rail parallel to each other, with one being virtually straight above the other, and as far apart as possible from each other, and placing in the adjacencies thereof the portion for transmitting driving force to the timing belt, the encoder, and the encoder scale, increase the measurement of the carriage in terms of vertical direction, resulting in the increase in the overall height of a recording apparatus, which is a problem.

The height of a recording apparatus can be reduced by positioning the guiding shaft and guiding rail roughly at the same level. This solution creates a different problem. That is, placing the guiding rail as far apart from the guiding shaft as possible, with the guiding rail placed on the opposite side of the center of gravity of the combination of the carriage and recording head, from the guiding shaft, while positioning the guiding rail roughly at the same level as the guiding shaft, and in parallel to the guiding shaft, increases the amount of the rotational moment induced in the carriage, rendering the carriage unstable in attitude, while the carriage is reciprocally moved, which is a problem.

SUMMARY OF THE INVENTION

The primary object of the present invention is to substantially reduce the carriage moving portion in height while raising the level of recording accuracy thereof, in order to provide a recording apparatus substantially smaller in vertical dimension and superior in recording accuracy, compared to a recording apparatus in accordance with the prior art.

Another object of the present invention is to provide a recording apparatus comprising: a carriage which is reciprocally moved, while holding a recording head, in the recording apparatus; a guiding shaft for guiding the carriage in the predetermined direction in which the carriage is reciprocally moved; a driving force transmitting portion for transmitting the carriage moving force to a member for reciprocally moving the carriage; a long and narrow member on which the information for determining the carriage position, in terms of the direction in which the carriage is reciprocally moved, and which extends in the direction in which the carriage is reciprocally moved; and a detecting member attached to the carriage and used for reading the information on the long and narrow member, in order to determine the carriage position, in terms of the direction in which the carriage is reciprocally moved, wherein the long and narrow member is located on the opposite side of the carriage from the guiding shaft.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the preferred embodiments of the present invention will be described with reference to the appended drawings. The recording medium on which recording is made by the recording apparatus in this embodiment will be described as paper. However, the present invention is also applicable to recording apparatuses which are capable of recording on flexible sheet, such as plastic sheet, that is, recording medium other than paper.

Figure 1:
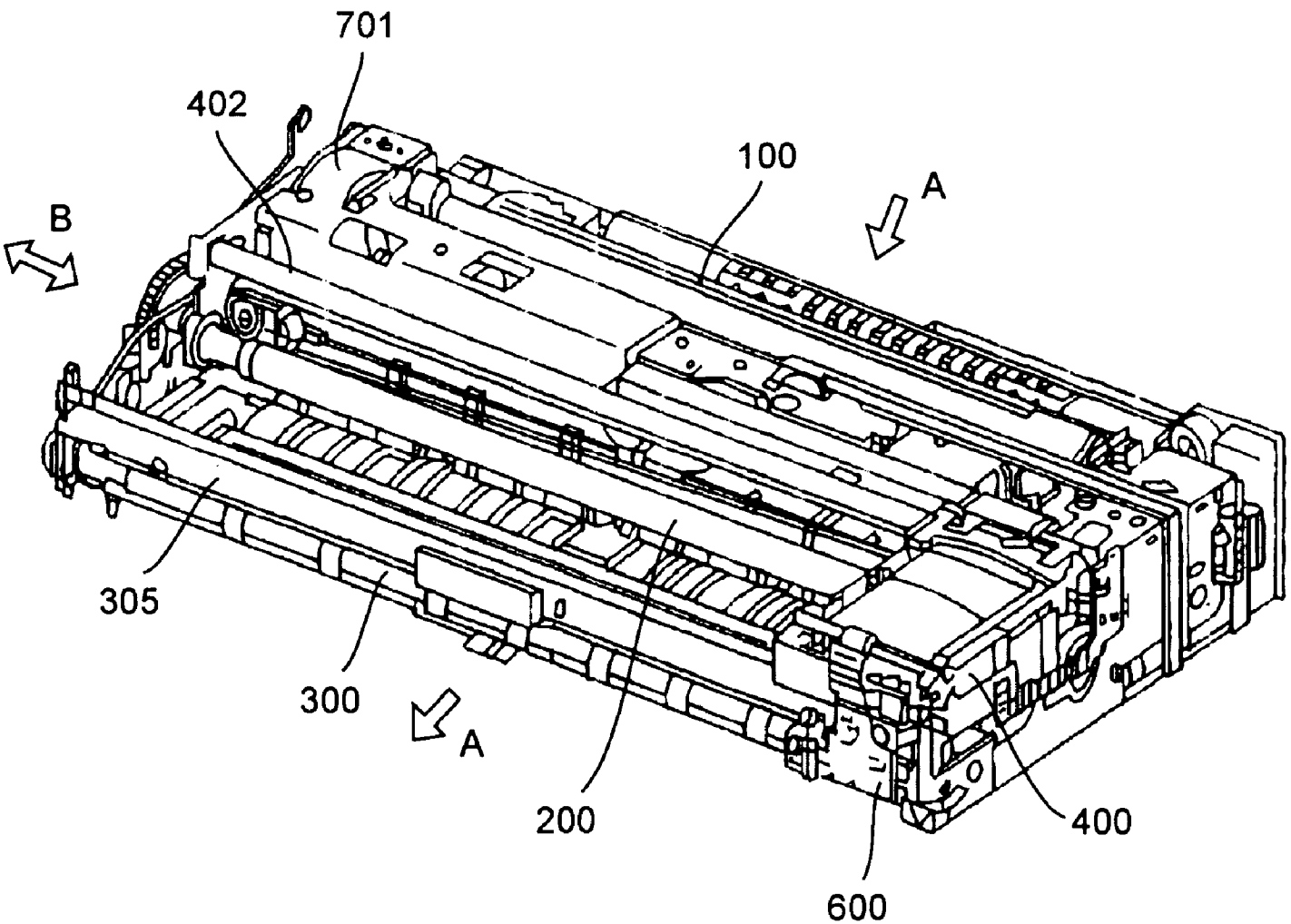
FIG. 1 is a perspective view of a recording apparatus, in accordance with the present invention, the outer shell of which has been removed to show the entirety of the recording mechanism.

FIG. 1 shows the serial type recording apparatus, in one of the preferred embodiments of the present invention, the external shell of which has been removed to show the entirety of its recording mechanism.

To describe the carriage driving mechanism in this embodiment, in sections, roughly in terms of their functions, the carriage driving mechanism comprises: an automatic sheet feeding station 100 which automatically feeds recording papers P (unshown), one by one, to a sheet conveying portion 200 in the main assembly of the recording apparatus; a sheet conveying portion 200 which guides each recording sheet P to the predetermined recording position as it is delivered to the sheet conveying portion 200, and which discharges the recording paper P from the recording position; a discharging portion 300 positioned below the conveying portion 200; a recording portion 400 which records a desired image on the recording sheet P delivered to the conveying portion 200; and a performance restoring portion 600 which restores the performance of the recording portion; etc. Generally speaking, these mechanical portions are integrally held by the chassis 701. The direction in which the recording sheet P is conveyed is the direction indicated by an arrow mark A, and the direction in which the recording portion 400 is reciprocally moved is the direction indicated by an arrow mark B, in FIG. 1.

The recording portion 400 comprises a carriage 401 and a recording head cartridge. The carriage 401 is movably supported by a guiding shaft 402, as the primary guiding member, and a guiding rail 305. The recording head is removably mountable in the carriage 401.

The recording head cartridge in this embodiment is of the so-called cartridge type. In other words, it is removably mountable in the carriage 401, which will be described later. The recording head cartridge comprises: an ink jet recording head 500 which ejects ink in accordance with recording data; and an ink container 502 which holds ink and is removably attachable to the recording head 500.

The recording head cartridge in this embodiment is capable of recording in color. Therefore, it comprises a plurality of recording heads, an ink container 502 which holds black ink, an a color ink container which holds cyan, magenta, and yellow inks. These ink containers are removably connectible to the recording head cartridge. The recording head cartridge is also provided with a circuit board (unshown) for transmitting driving signals to the recording head 500.

The carriage 401 is provided with a head setting lever 403 (FIG. 2) for guiding and positioning the recording head cartridge after the placement of the recording head cartridge in the carriage 400.

Figure 2:
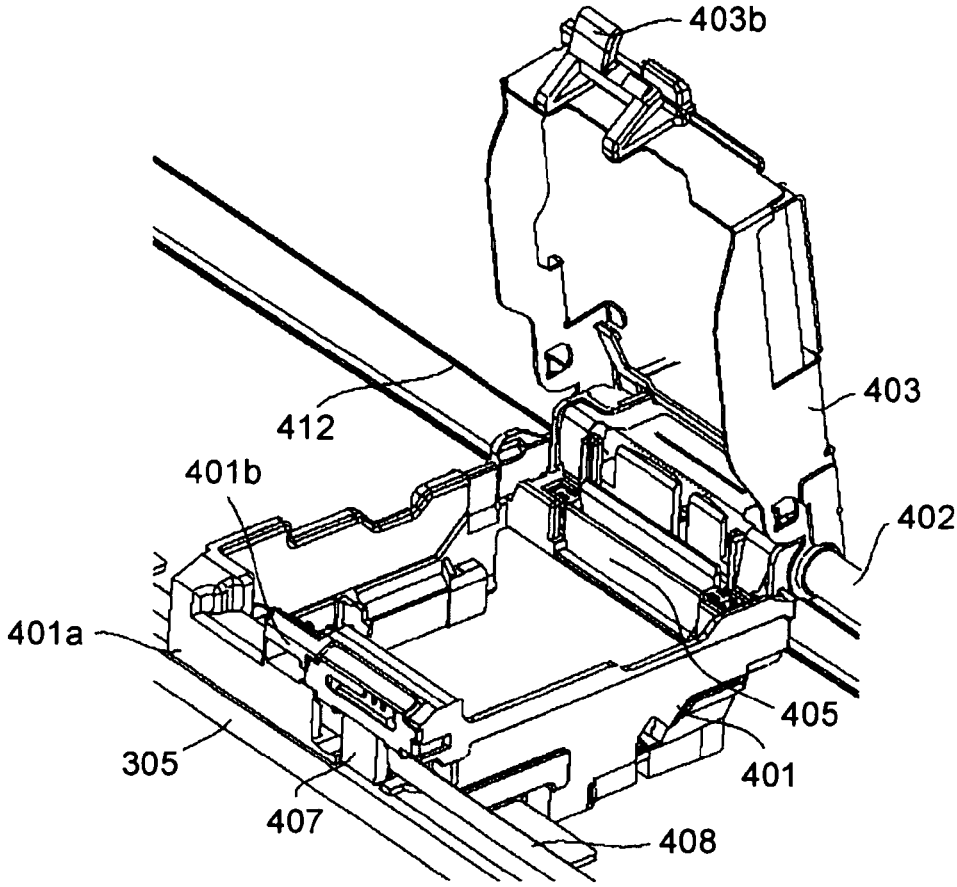
FIG. 2 is a perspective view of the carriage, and its adjacencies, of the recording apparatus in accordance with the present invention, the head setting lever of which is in the open position.

FIG. 2 is a perspective view of the carriage 401, the head setting lever 403 of which is in the raised position.

The head setting lever 403 is rotatably attached to the carriage 401, and is to be pressed by a user to guide the recording head cartridge to the correct recording head cartridge position in the carriage 401, and solidly holds the cartridge thereto.

The circuit board (unshown) of the recording head cartridge is provided with a signal reception terminal (unshown) for receiving external signals, whereas the carriage 401 is provided with a head connector 405 having contact pins (unshown). As the recording head cartridge is mounted into the carriage 401, the external signal receiving terminal of the circuit board become electrically connected to the head connector 405 of the carriage 401, making it possible for the recording head cartridge and apparatus main assembly to exchange various data for recording, through the carriage 401, and to supply the recording head 500 with electricity.

In order to prevent the head connector 405 from interfering with the process of precisely positioning the recording head cartridge relative to the carriage 40, the head connector 405 is held to the carriage 401 so that it is movable relative to the carriage 401.

In other words, the head connector 405 is connected to the carriage 401 in such a manner that the recording head cartridge remains electrically connected to the carriage 401 even if the head connector 405 moves after the precise positioning of the recording head cartridge relative to the carriage 401.

The head setting lever 403 is rotatably supported by the carriage 401, so that its rotational axis virtually coincides with the axis of the guiding shaft 402.

The head setting lever 403 is to be rotated by a user to a point at which the hook of the latch 403*b* of the head setting lever 403 engages with the head setting lever catch 401*b* of the carriage 401, after the placement of the recording head cartridge in the carriage 401. As the head setting lever 403 is rotated, the positioning surfaces of the recording head cartridge and carriage 401 come into contact with each other. As a result, the recording head cartridge is precisely positioned relative to the carriage 401, ending the process of mounting the recording head cartridge into the carriage 401.

In order to remove the recording head cartridge from the carriage 401, a user is to press the latch 403*b* of the head setting lever 403 so that the hook of the latch 403*b* disengages from the head setting lever catch portion 401*b* of the carriage 401, and then, to rotate the head setting lever 403 in the opening direction.

Figure 3:
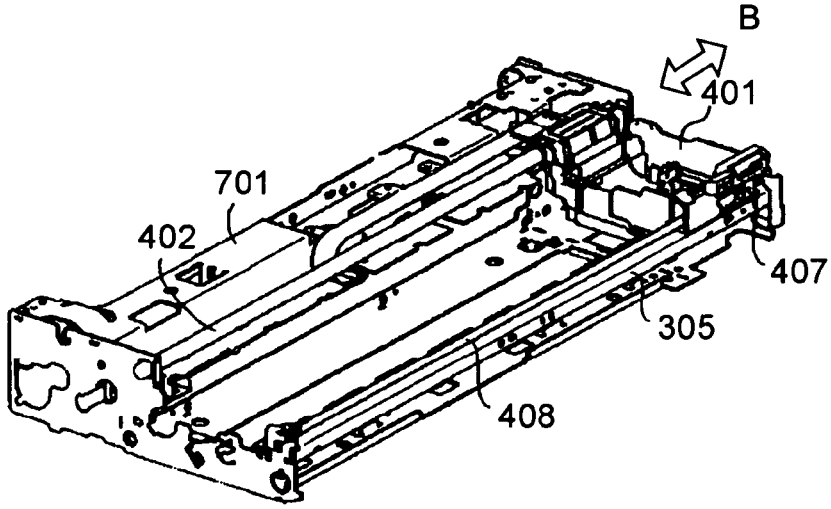
FIG. 3 is a perspective view of the recording apparatus, in accordance with the present invention, the carriage, and the components for driving the carriage, of which have been removed.
Figure 4:
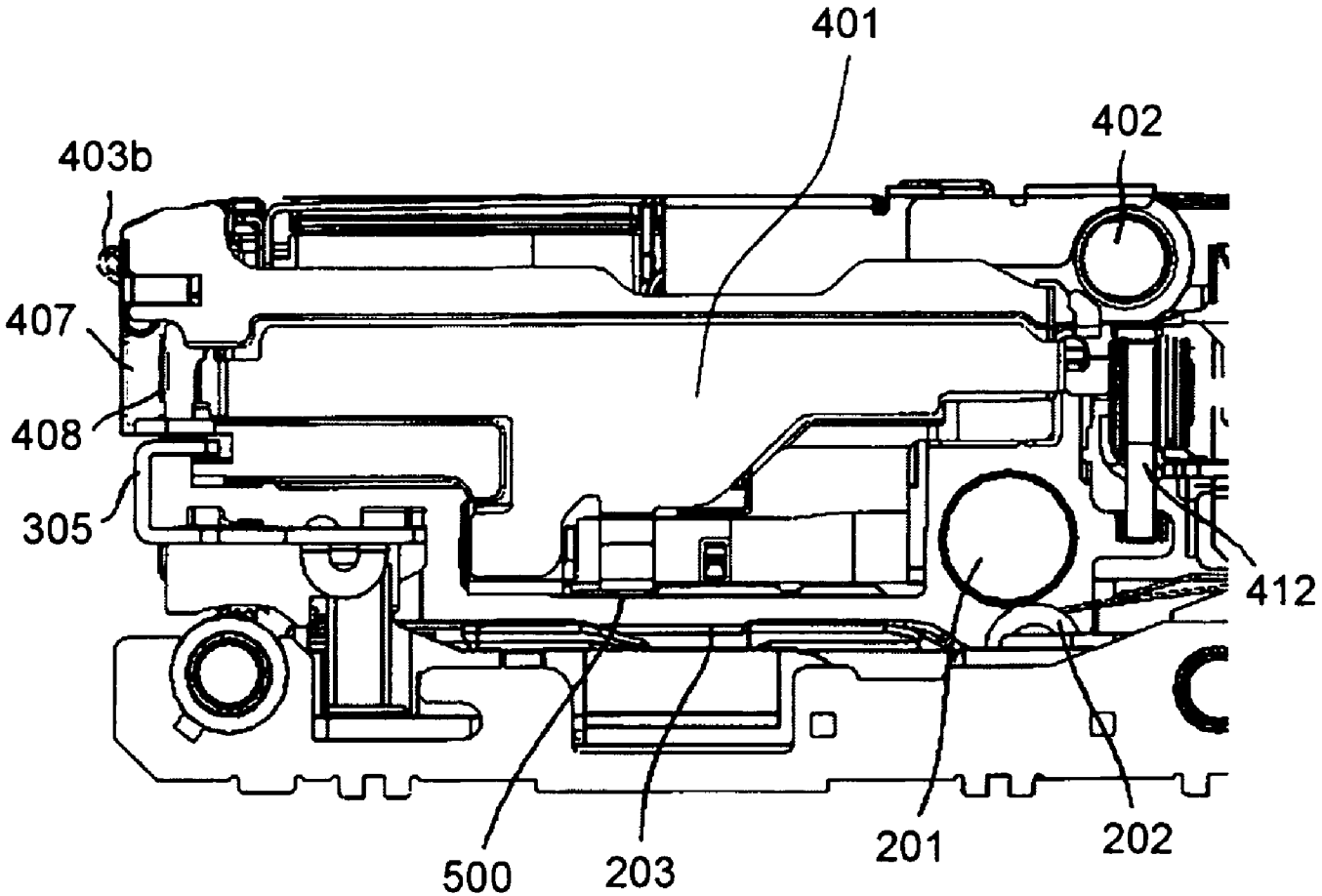
FIG. 4 is a side view of the carriage and carriage driving portion of the recording apparatus in accordance with the present invention.

FIG. 3 is a perspective view of the recording apparatus, in this embodiment, the carriage 401 and carriage moving components of which have been removed. FIG. 4 is a side view of the carriage 401 and the carriage moving portion.

The main assembly of the recording apparatus is provided with an encoder scale 408, which is positioned parallel to the guiding shaft 402, extending between the lengthwise end walls of the chassis 701. Further, the carriage 401 is provided with an encoder sensor 407, which detects the information on the encoder scale 408 to determine the position, speed, etc., of the carriage 401.

In this embodiment, the encoder sensor 407 is an optical sensor of a transmission type. The encoder scale 408 comprises a strip of resinous film, such as polyester film, and light blocking portions printed thereon by photolithographic printing, at a predetermined pitch (with presence of predetermined intervals as light transmitting portions), for blocking the light emitted from the encoder sensor 405.

The carriage 401 is moved along the guiding shaft 402, and its position is calculated (determined) with reference to one of the lengthwise end walls of the chassis 701, that is, the chassis walls located at the ends, one for one, of the moving range of the carriage 401, more precisely, the point at which the carriage 40 makes contact with the above-described wall of the chassis 701. The position of the carriage 401 is continuously detected; as the carriage 401 is moved, the pattern on the encoder scale 408 is counted by the encoder sensor 407.

The apparatus main assembly is also provided with a carriage belt 412, as a means for reciprocally moving the carriage, to which the carriage belt 412 is attached. The carriage belt 412 is stretched between an idler pulley (unshown) and a CR motor pulley (unshown), roughly parallel to the guiding shaft 402, in the adjacencies of the aforementioned end walls of the chassis 701, one for one.

As the CR motor (unshown) is driven forward or in reverse, the CR motor pulley (unshown) is rotated forward or in reverse, causing thereby the carriage belt 412 to move forward or in reverse. As a result, the carriage 401 is moved forward or in reverse along the guiding shaft 402.

Further, the apparatus main assembly is provided with the combination of an LF roller 201 and a pinch roller 202, which are rotated, while nipping the recording sheet P (unshown), conveying thereby the recording paper P. While the recording paper P is conveyed, it is guided by the platen 203, being thereby kept a predetermined distance away from the recording head 500, so that the ink droplets ejected from the recording head 500 precisely land on the recording paper P to form a highly precise image.

The aforementioned guiding rail 305 is located on the opposite side of the recording head 500 from the guiding shaft 402 and carriage belt 412. The guiding rail 305 controls the attitude of the carriage 401, across the entirety of the moving range of the carriage 401, so that while the carriage 401 is reciprocally moved, the predetermined distance is maintained between the recording head 500 and recording paper P as described above.

The encoder sensor 407 is located above the guiding rail 305 (in the top portion of the main assembly of the recording apparatus), being therefore located on the opposite side of the recording head 500 from the guiding shaft 402 and carriage belt 412.

As will be evident from FIG. 4, placing the guiding rail 305 roughly at the same level as the guiding shaft 402 while placing the encoder sensor 407 above the guiding rail 305 (in the top portion of the recording apparatus main assembly), substantially reduces the height of the carriage moving portion, reducing in turn the overall height of the recording apparatus.

As driving force is transmitted to the carriage 401 through the carriage belt 412, in the recording apparatus structured as described above, this driving force acts in the direction to rotate the carriage 401 parallel to the plane parallel to recording sheet P, because the center of gravity of the combination of the recording head cartridge and carriage 401 is between the guiding shaft 402 and guiding rail 305; in other words, the driving force acts in the direction to change the attitude of the carriage 401. Moreover, the friction between guiding rail 305 and carriage 401 also acts in the direction to rotate the carriage 401. As a result, the rotational moment is induced in the carriage 401, which is likely to change the carriage 401 in attitude. The changes in the attitude of the carriage 401 caused by the driving force, as described, change the position of the recording head 500 relative to the encoder sensor 407. Since the recording head 500 is driven by the recording head driving signals generated in coordination with the detection signals from the encoder sensor 407, the changes in the position of the recording head 500 relative to the encoder sensor 407 result in the changes in the position of the spot on the recording paper P on which each ink droplet lands, which in turn frequently lowers the level of preciseness at which an image is recorded; an image nonuniform in appearance is formed.

However, the encoder sensor 407 of the recording apparatus in accordance with the present invention is positioned a substantial distance away from the guiding shaft 402, in the apparatus main assembly. Therefore, the amount of the deviation in the position of the encoder sensor 407 relative to the guiding shaft 402, which is caused by the above described changes in the attitude of the carriage 401, is greater than the amount of the deviation in the position of the recording head 500 relative to the guiding shaft 402, which also is caused by the changes in the attitude of the carriage 401. In other words, the deviation in the position of the recording head 500 relative to the guiding shaft 402 is detected in amplification by the encoder sensor 407. Thus, the attitude of the carriage 401 is controlled in response to the signals generated in accordance with the amplified amount of the deviation in the attitude of the carriage 402. Therefore, the carriage 401 is better controlled in attitude and speed, being therefore kept more accurate in attitude and speed, while it is reciprocally moved. Moreover, the amount of the deviation in the position of the recording head 500 relative to the guiding shaft 402 is smaller than the that of the encoder sensor 407 relative to the guiding shaft 402. Therefore, the amount of the deviation in the position of the landing point of each ink droplet, on the recording paper P is smaller, further improving the level of preciseness at which recording is made.

The encoder scale 408 is kept straight by being hooked to a claw of the chassis 701 by one end, and an encoder scale spring (unshown) by the other end. The encoder scale spring is provided with a bend preventing portion (unshown), in addition to a claw to which the encoder scale 408 is hooked. The bend preventing portion comes into contact with the chassis 701 as the encoder scale spring is flexed. More specifically, as the recording apparatus is subjected to the impacts resulting from falling of the recording apparatus, or the encoder scale 408 is accidentally pulled by a user when the user is required to touch the internal components of the recording apparatus, for example, when the user must replace the ink container(s), or deal with a jam (remove recording paper jammed in the apparatus), this bend preventing portion comes into contact with the chassis 701, preventing thereby the encoder scale 408 from becoming unhooked, and/or the encoder scale spring from deforming.

Figure 5:
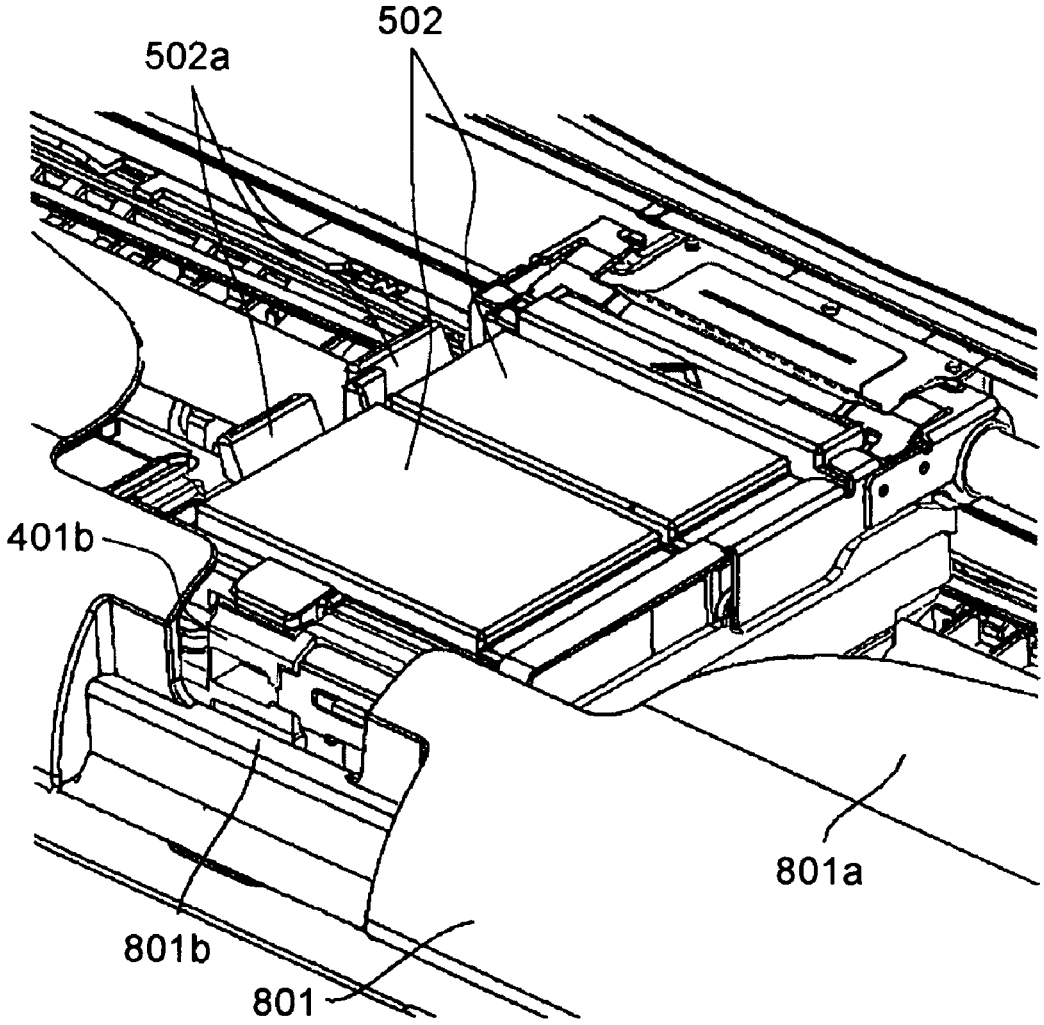
FIG. 5 is a drawing for describing the operation to be carried out by a user in order to replace the ink container in the recording apparatus.

Next, referring to FIG. 5, the operation to be carried out by a user in order to replace the ink container will be described. The top shell 801 is provided with a top opening for replacing the recording head cartridge or the ink container 502, removing the jammed recording paper from the recording apparatus, or cleaning the interior of the recording apparatus as necessary.

In order to make it easier to replace the recording head cartridge or ink container 502, the top opening is desired to be wider across the center portion of the recording apparatus, in terms of the direction parallel to the direction in which the carriage 401 is reciprocally moved; the portions of the top opening other than the center portion has only to be have the minimum width necessary to remove the recording papers or cleaning the interior. More specifically, the top shell 801 is provided with eave-like portions 801*a* which cover the top and front portions of the encoder scale 408 (top and front portion of apparatus main assembly), across the entirety of the opening of the top shell 801. Further, the top shell 801 is provided with a side opening 801*b*, which extends outward from the aforementioned wide center portion of the top opening 801*a*, allowing the latch 403*b* of the head setting lever 403 to be operated by the user.

The carriage 401 is provided with a tunnel-like portion 401*a*, which is located next to the encoder sensor 407, in terms of the direction in which the carriage 401 is reciprocally moved. The tunnel-like portion 401*a* covers the encoder scale 408. The aforementioned head setting lever catching portion 401*b* of the carriage 401 is above this tunnel-like portion 401*a*.

In order to mount or dismount the ink container 502, the latches 502*a* of the ink container 502 are to be disengaged from the carriage 401. With the latches 502*a* disengaged from the carriage 401, the ink container 502 can be mounted or dismounted without removing the recording head cartridge. The latches 502*a* are located so that they face one of the lateral walls perpendicular to the direction in which the carriage 401 is reciprocally moved.

When it becomes necessary to replace the ink container 502, the following steps are to be taken by a user. That is, first, the user is to initiate the predetermined ink container replacement process, in order to stop the carriage 401 roughly at the center of the recording apparatus, where the latch 403*b* of the heat setting lever 403 is not exposed through the side opening 801*b* of the top shell 801 (FIG. 5). When the carriage 401 is at this location, the user cannot press the latch 403*b* of the head setting lever 403, because the latch 403*b* is hidden behind the top shell 801, preventing the user from carrying out an unnecessary operation, that is, the operation to disengage the the hook of the latch 403*b* of the head setting lever 403 in order to remove the recording head cartridge. All that is necessary to remove the ink container 502 is to disengage the latches 502*a* of the ink container 502, making it unnecessary to expose the latch latch 403*b* of the head setting lever 403. Therefore, stopping the carriage 401 at the above described location does not create any problem as far as the replacement of the ink container 502 is concerned.

When the carriage 401 is at the above described ink container replacement location, the encoder scale 408 remains covered by the eave-like portion 801*a* of the top shell 801, and the encoder sensor 407 remains covered by the tunnel-like portion 401*a* (cover portion) of the carriage 401. Therefore, the user is prevented from accidentally touching or pulling the encoder scale 402, being therefore prevented from adhering foreign substances, which affect the reading of the encoder scale 408 by the encoder sensor 407, to the surface of the encoder scale 408, or causing such a damage as the dislodgment of the encoder scale 408.

Figure 6:
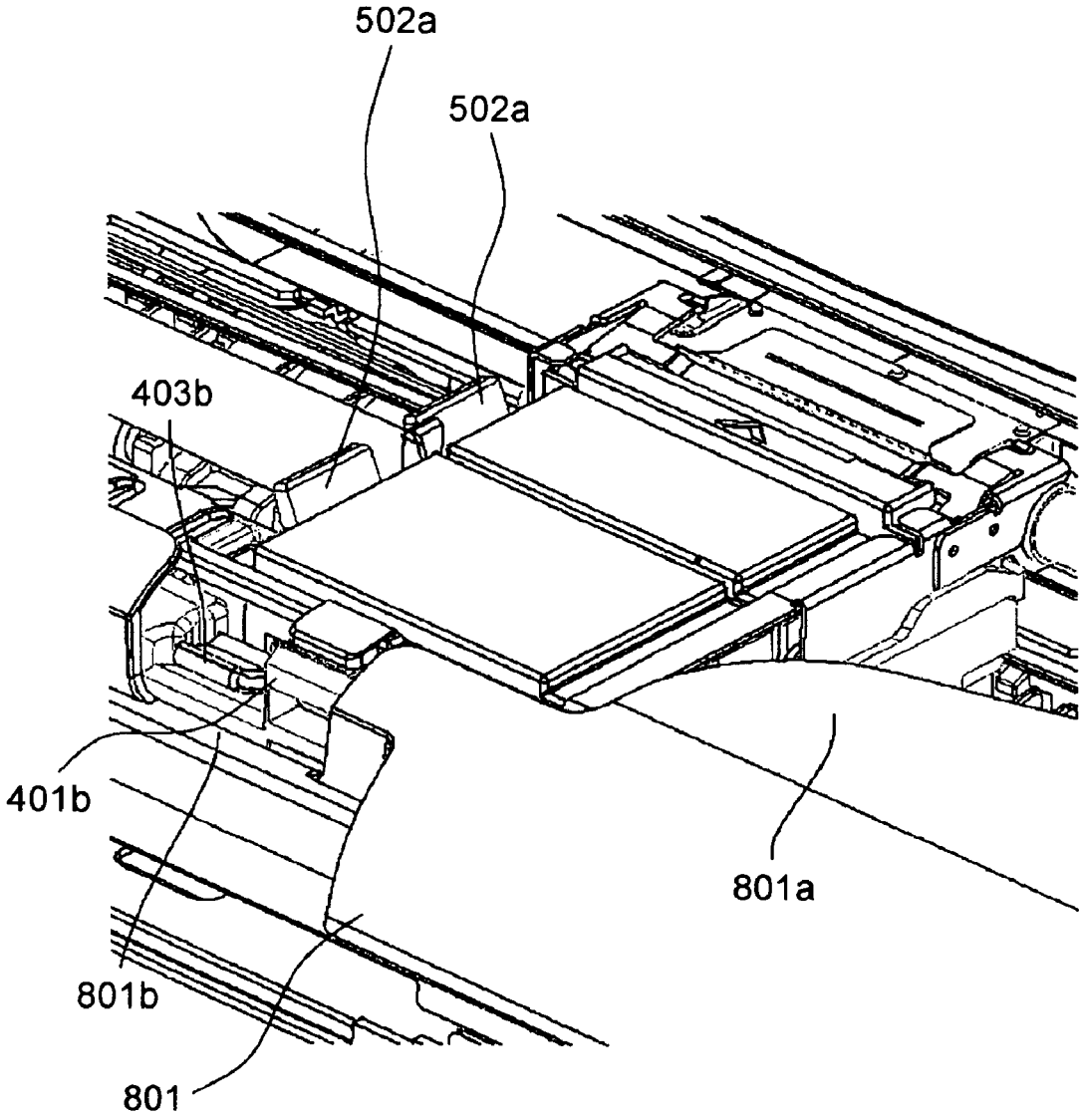
FIG. 6 is a drawing for describing the operation to be carried out by a user in order to replace the recording head cartridge in the recording apparatus.

Next, referring to FIG. 6, the steps to be carried out by a user in order to replace the recording head cartridge will be described.

When it becomes necessary to remove the recording head cartridge, the following steps are to be carried out by the user. That is, first, the user is to initiate the predetermined recording head cartridge removal process by performing the first step thereof. As the first step is performed, the carriage 401 is moved to the location at which the latch 403*b* of the head setting lever 403 is exposed through the side opening 801*b* of the top shell 801, and is stopped there. Next, the user is to press the latch 403*b* of the head setting lever 403 accessible through the side opening 801*b* in order to disengage the latch 403*b*. Then, the user is to remove the recording head cartridge. When the carriage 401 is at this recording head cartridge removal location, the encoder scale 408 remains covered by the eave-like portion 801*a* of the top shell 801, and the encoder sensor 407 remains covered by the tunnel-like portion 401*a* (cover portion) of the carriage 401. Therefore, the user is prevented from accidentally touching or pulling the encoder scale 408, being therefore prevented from adhering foreign substances, which affect the reading of the encoder scale 408 by the encoder sensor 407, to the surface of the encoder scale 408, or causing to the recording apparatus, such a damage as the dislodgment of the encoder scale 408.

In other words, according to the present invention, the encoder scale attached to the carriage remains covered when the carriage is at the ink container replacement location, or the recording head cartridge replacement location. Therefore, even if the encoder scale is positioned on the front side of the recording apparatus, where the encoder scale is prone to be touched by the hand of a user, it is not likely to be accidentally touched by the user's hand. Thus, the present invention makes it possible to provide a highly reliable recording apparatus, that is, an ink jet recording apparatus which does not suffer from the problem that it is damaged by the accidental operations performed by a user.

Incidentally, in order to assure that a user will always perform the above described first step of the recording head cartridge replacement process, or ink container replacement process, before the user will attempt to replace the recording head cartridge or ink container, the main assembly of the above described recording apparatus may be provided with an access cover (unshown) for covering the top and side openings of the top shell 801, and a detecting means for detecting the opening or closing of this access cover, so that opening this access cover triggers the first step of the recording head cartridge replacement process, or the ink container replacement process. With this structural arrangement, an attempt by a user to access the inward side of the top shell 801 always triggers the first step of the process for protecting the encoder scale, assuring that the recording apparatus will not be damaged by the user.

Further, the recording apparatus may be provided with a servomechanism for servo-controlling the carriage in terms of position, that is, such a mechanism that constantly detects the position of the carriage 401 with the use of the encoder sensor 407, after the positioning of the carriage 401 at the recording head cartridge replacement location, or ink container replacement location, and returns the carriage 401 to the recording head replacement location, or ink container replacement location, in response to the detected position of the carriage, should the carriage 401 be displaced therefrom after the positioning of the carriage 401 at the recording head cartridge replacement location, or ink container replacement location. With the provision of this servomechanism, it is assured that once the carriage 401 is positioned at the recording head cartridge replacement location or ink container replacement location, it will be kept there, preventing thereby an operator from accidentally touching the encoder scale when the operator reaches inward of the top or side opening of the top shell 801, assuring thereby that the recording apparatus will not be damaged by the accidental touching of the interior portions of the recording apparatus main assembly by a user.

Also according to the present invention, the head setting lever catching portion 401*b* of the carriage 401 is located above the tunnel-like portion 401*a* of the carriage 401, which is located next to the encoder sensor 407, in terms of the direction in which the carriage 401 is reciprocally moved, for the purpose of covering the encoder scale 408 (portion 401*b* is located in top portion of recording apparatus), substantially reducing the size of the carriage moving portion, reducing therefore the overall height of the recording apparatus.

In the above described preferred embodiment of the present invention, the carriage 401 is provided with only one head setting lever catching portion 401*b*, which is located next to the encoder sensor 407. However, the carriage 401 may be provided with two head setting lever catching portions 401*b*, which are located on both sides of the carriage 401, one for one, in terms of the direction in which the carriage 401 is reciprocally moved. With the provision of two lever catching portions 401*b*, the head setting lever 403 remains more securely latched. Obviously, the carriage 401 may be provided with three or more head setting lever catching portions 401*b*, as long as such an arrangement makes it possible to keep the head setting lever 403 more securely latched.

Although the serial type recording apparatus in this embodiment employs an ink jet recording head, the application of the present invention is not limited to a serial type recording apparatus which employs an ink jet recording head. For example, the present invention is also applicable to a serial type recording apparatus which employs a recording head of a thermal transfer type.

Further, not only is the above described encoder placement in accordance with the present invention applicable to the above described recording apparatus which employs the ink jet recording head, but also, to a serial type recording apparatus, on the carriage of which an optical reader, such as a scanner head, virtually identical in size and shape, is mountable in place of the recording head cartridge. With the encoder positioned as described above, the carriage, which is holding the optical reader, can be kept more stable in speed and attitude while an original is read by the scanner head, and therefore, the amount of reading errors which the scanner makes will be smaller; in other words, the original will be read at a higher level of accuracy.

To summarize, according to one of the characteristic aspects of the present invention, the position detecting means for detecting the position of the head holding member for holding a recording head is disposed on the opposite side of the recording head from the guiding member for guiding the head holding member, and a substantial distance away from the head guiding member. As a result, the amount of the deviation in the position of the recording head is detected in amplification by the head position detecting means.

Therefore, the position of the head holding member (recording head position) can be fed back to the means for controlling the position of the head holding member (recording head position) at a higher level of accuracy, and also, the recording head driving signals can be generated at a higher level of accuracy.

According to another characteristic aspect of the present invention, the guiding shaft as a guiding member is disposed roughly at the same level as the guiding rail. Therefore, even if the amount of torque to which the head holding member is subjected increases during the reciprocal driving of the head holding member, the head holding member is kept stable in attitude. Not only do the above-described placement of the head holding member position detecting means and placement of the guiding member synergistically raise the level of accuracy at which recording is made, but also, make it possible to drastically reduce the height of the carriage moving portion, making it therefore possible to provide a recording apparatus drastically smaller in overall height compared to a recording apparatus in accordance with the prior art.

While the invention has been described with reference to the structures disclosed herein, it is not confined to the details set forth, and this application is intended to cover such modifications or changes as may come within the purposes of the improvements or the scope of the following claims.

What is claimed is:

1. A recording apparatus for effecting recording on a recording medium, said apparatus comprising:

a carriage for carrying a recording head and being scanningly movable in said apparatus;

a platen for supporting a recording medium at a position opposed to the recording head;

a guide shaft, disposed at a position upstream of a recording position where the recording head is opposed to said platen, with respect to a feeding direction of the recording medium, for guiding a scanning movement of said carriage;

a belt, disposed at a same side as said guide shaft with respect to the recording position and for transmitting a driving force to said carriage;

a guide rail, disposed at a side across the recording position from said guide shaft with respect to the feeding direction of the recording medium, for guiding the scanning movement of said carriage;

an encoder scale, having a recorded information relating to positions of said carriage with respect to the scanning direction, for determining information relating to a position of said carriage;

an encoder sensor, provided on said carriage, for detecting the information relating to the position of said carriage with respect to the scanning direction, said encoder sensor being disposed at a side across the recording position from said guide shaft with respect to the feeding direction of the recording medium;

a head set lever for mounting and demounting of the recording head relative to said carriage; and a latch engagement portion for engagement with a latch portion of head set lever, said latch engagement portion being disposed at a lateral side of said encoder sensor with respect to the scanning direction of said carriage.

2. An apparatus according to claim 1, further comprising a casing having an opening for detachably mounting the recording head to said carriage.

3. A recording apparatus for effecting recording on a recording medium, said apparatus comprising:

a carriage for carrying a recording head and being scanningly movable in said apparatus;

a platen for supporting a recording medium at a position opposed to the recording head;

a guide shaft, disposed at a position upstream of a recording position where the recording head is opposed to said platen, with respect to a feeding direction of the recording medium, for guiding a scanning movement of said carriage;

a belt, disposed at a same side as said guide shaft with respect to the recording position, for transmitting a driving force to said carriage;

a guide rail, disposed at a side across the recording position from said guide shaft with respect to the feeding direction of the recording medium, for guiding the scanning movement of said carriage;

an encoder scale, having recorded information relating to positions of said carriage with respect to the scanning direction, for determining information relating to a position of said carriage;

an encoder sensor, provided on said carriage, for detecting the information relating to the position of said carriage with respect to the scanning direction, said encoder sensor being disposed at a side across the recording position from said guide shaft with respect to the feeding direction of the recording medium;

a head set lever for mounting and demounting of the recording head relative to said carriage, said head set lever being supported on said carriage for rotation substantially coaxially with said guide shaft; and a latch engagement portion for engagement with a latch portion of head set lever.

4. An apparatus according to claim 3, further comprising a casing having a opening for detachably mounting the recording head to said carriage.

* * * * *

UNITED STATES PATENT AND TRADEMARK OFFICE

CERTIFICATE OF CORRECTION

PATENT NO. : 7,314,265 B2
APPLICATION NO. : 10/764547
DATED : January 1, 2008
INVENTOR(S) : Sato It is certified that error appears in the above-identified patent and that said Letters Patent is hereby corrected as shown below:

COLUMN 1:
Line 22, “toward” should read --toward a--.
Line 34, “out” should read --our--.
Line 46, “which” should read --which a--.

COLUMN 2:
Line 25, “to” should read --to the--, and “of” should read --of the--.
Line 58, “in” should be deleted.

COLUMN 5:
Line 9, “an” should read --and--.

COLUMN 6:
Line 24, “carriage 40” should read --carriage 401--.

COLUMN 7:
Line 33, “above” should read --above- --.
Line 43, “carriage 402.” should read --carriage 401.--.

COLUMN 8:
Line 16, “has only” should read --only has--, and “be” should be deleted.
Line 18, “cleaning” should read --clean--.
Line 47, “heat” should read --head--.
Line 57, “latch” should be deleted.
Line 59, “above described” should read --above-described--.
Line 62, “above described” should read --above-described--.

COLUMN 9:
Line 1, “scale 402,” should read --scale 408,--.
Line 45, “above described” should read --above-described--.
Line 49, “above described” should read --above-described--.

UNITED STATES PATENT AND TRADEMARK OFFICE

CERTIFICATE OF CORRECTION

PATENT NO. : 7,314,265 B2
APPLICATION NO. : 10/764547
DATED : January 1, 2008
INVENTOR(S) : Sato It is certified that error appears in the above-identified patent and that said Letters Patent is hereby corrected as shown below:

COLUMN 10:
Line 21, “in” should read --in the--.
Line 25, “above described” should read --above-described--.
Line 46, “above described” should read --above-described--.
Line 48, “above described” should read --above-described--.

COLUMN 11:
Line 11, “subjected” should read --subjected to--.

Signed and Sealed this

Third Day of March, 2009

John Doll

JOHN DOLL
*Acting Director of the United States Patent and Trademark Office*